US005979408A

United States Patent [19]

Wakabayashi et al.

[11] Patent Number: 5,979,408

[45] Date of Patent: Nov. 9, 1999

[54] FUEL INJECTION SYSTEM

[75] Inventors: Junichi Wakabayashi; Nobuyuki Oka, both of Fujisawa, Japan

[73] Assignee: NOK Corporation, Tokyo, Japan

[21] Appl. No.: 08/856,170

[22] Filed: May 14, 1997

[30] Foreign Application Priority Data

May 14, 1996 [JP] Japan ..... 8-142307
May 29, 1996 [JP] Japan ..... 8-156406

[51] Int. Cl.[6] ..... F02M 37/00

[52] U.S. Cl. ..... 123/455; 123/458; 137/541

[58] Field of Search ..... 123/458, 472, 123/455, 452, 453; 137/541, 542, 533.11

[56] References Cited

U.S. PATENT DOCUMENTS

| | | | |
|---|---|---|---|
| 2,086,969 | 7/1937 | Strelow | 137/542 |
| 2,255,203 | 9/1941 | Wiegand | 137/542 |
| 2,808,293 | 10/1957 | Schenk | 137/542 |
| 3,970,063 | 7/1976 | Mayr | 123/455 |
| 4,181,144 | 1/1980 | Landen | 137/541 |
| 4,722,312 | 2/1988 | Yamada | 123/458 |
| 4,886,085 | 12/1989 | Miller | 137/542 |
| 4,909,220 | 3/1990 | Field | 123/458 |
| 4,941,447 | 7/1990 | Mannhardt | 123/455 |
| 4,958,773 | 9/1990 | Stettner et al. . | |
| 5,004,009 | 4/1991 | Bunce | 137/541 |
| 5,070,845 | 12/1991 | Avdenko et al. . | |
| 5,341,785 | 8/1994 | Meaney | 123/458 |

FOREIGN PATENT DOCUMENTS

| | | | |
|---|---|---|---|
| 86323 | 5/1895 | Germany | 137/541 |

*Primary Examiner*—Carl S. Miller
*Attorney, Agent, or Firm*—Jacobson, Price, Holman & Stern, PLLC

[57] ABSTRACT

A fuel injection system (10) for a multiple-cylinder engine includes a single solenoid-operated fuel metering valve (12) connected through fuel lines (50) to a plurality of fuel injection nozzles (52). The fuel metering valve (12) has a solenoid-operated movable valve member (14) that opens and closes a single discharge opening (26) having a first metering orifice (58). Each injection nozzle (52) has an equally calibrated second metering orifice (90) that serves to distribute the fuel metered by the first orifice evenly over all of the fuel injection nozzles. Preferred forms of the fuel injection nozzle is also disclosed.

10 Claims, 5 Drawing Sheets

FUEL INJECTION SYSTEM

BACKGROUND OF THE INVENTION

1. Field of the Invention

The present invention relates to a fuel injection system for a spark-ignited, multiple-cylinder, internal combustion engine.

2. Description of the Prior Art

Fuel injection systems having solenoid-operated injection valves controlled by electronic engine control units have been widely used because of their capability of forming a combustible mixture having a desired air-to-fuel ratio in response to varying engine parameters such as engine speed and power demands.

Typically, the conventional fuel injection systems for multiple-cylinder engines may be grouped into two categories; a single-point injection system and a multiple-point injection system, also known as a throttle body injection system and a port injection system.

The single-point injection system includes one or more solenoid-operated injection valves that spray metered fuel into the flow of intake air flowing through the throttle body, the combustible charge thus formed being distributed through an intake manifold to respective engine cylinders. The problem of the single-point injection system is the difficulty in distributing the same amount of fuel into each cylinder.

This problem is solved by the multiple-point injection system wherein each intake port is provided with an injection valve to ensure that the same amount of fuel is injected in each intake port. However, the multiple-point injection system is complicated in structure and is therefore costly.

U.S. Pat. No. 4,958,773 to Stettner et al. and U.S. Pat. No. 5,070,845 to Avdenko et al. disclose a simplified form of electronically controlled fuel injection system for a multiple-cylinder engine. The system includes a single injector or solenoid valve that meters fuel to a plurality of fuel lines each of which is connected to a fuel injection nozzle arranged in each intake port. The solenoid valve includes a movable valve member that cooperates with a valve seat to open and close a plurality of calibrated metering orifices formed on the valve seat, the metering orifices being in communication with respective fuel lines.

The advantage of the simplified fuel injection system referred-to above is that it is cost effective and is yet free from the problem of uneven fuel distribution inherent in the single-point injection system.

However, the problem of the simplified form of the fuel injection system is that it is difficult to meter fuel with a high degree of accuracy because the degree of opening of the metering orifices as the valve member is lifted away from the valve seat may fluctuate from orifice to orifice. To avoid this, the valve seat must be machined with a high precision so as to present a surface of a high flatness and the metering orifices must be calibrated with a high accuracy.

Another disadvantage is that a substantial pressure drop is developed across the metering orifices because each orifice is calibrated small enough to correspond to the flow rate through the individual injection nozzle. As a result, the differential pressure applied across the injection nozzles is limited. This entails a severe control of the opening pressure of the injection nozzles whereby a substantial time and labor are required for assembly, inspection and adjustment of the injection nozzles.

SUMMARY OF THE INVENTION

It is therefore an object of the present invention to provide a fuel injection system for a multiple-cylinder engine which is capable of metering fuel with a high degree of accuracy.

Another object of the invention is to provide a fuel injection system which is capable of distributing an equal amount of fuel into each cylinder of the engine.

A still another object of the invention is to provide a fuel injection system which is easy to manufacture and easy to assemble.

This invention provides a fuel injection system comprising a solenoid-operated fuel metering valve for metering fuel under pressure, a plurality of fuel injection nozzles, a plurality of fuel lines connected, respectively, at an end thereof to the fuel metering valve and at the other end to the injection nozzles for delivering fuel metered by the metering valve to the injection nozzles. According to the invention, the fuel metering valve has a single discharge opening and a disc valve member for controlling the discharge opening, the discharge opening being provided with a first metering orifice for metering fuel delivered to the totality of the fuel injection nozzles, each of the injection nozzles having a second metering orifice for metering fuel injected through each injection nozzle, the second metering orifices of all of the injection nozzles being equally calibrated so that fuel metered by the first orifice is distributed evenly to the fuel injection nozzles.

With this arrangement, the accuracy of metering is enhanced as the disc valve member opens and closes a single discharge opening.

As the first metering orifice has a relatively large diameter as compared with the diameter of the second orifice of each injection nozzle, the pressure drop across the fuel metering valve is limited.

The first metering orifice meters the total amount of fuel delivered to all of the fuel injection nozzles, whereas the second metering orifice of each injection nozzle ensures that an equal amount of fuel is injected into each cylinder. Accordingly, fuel is evenly distributed to all the cylinders.

In the preferred embodiment of the invention, the injection nozzle comprises: a nozzle body having an inlet for fuel under pressure, a discharge outlet, a passage connecting the inlet with the outlet, and a valve seat surrounding the outlet; a valve member having a closure member cooperating with the valve seat to control discharge of fuel through the outlet and a valve shaft connected to the closure member and extending into the passage; and, a coiled compression spring received in the passage for biasing the closure member into engagement with the valve seat, the spring extending around the valve shaft and having a first end supported by the body and a second end anchored to an inner end of the valve shaft; the spring being tapered from the first end to the second end to form a reduced diameter turn at the second end.

This arrangement advantageously stabilizes the spraying characteristics of the injection nozzle.

Preferably, the inner end of the valve shaft is flanged by upsetting to form a spring retainer for the second end of the tapered spring. As used herein, the term "inner" refers to the axial direction toward the inlet of the injection nozzle. This arrangement permits to reduce the mass of the valve member and to thereby improve the responsiveness of the nozzle.

Preferably, the nozzle body of the injection nozzle comprises a tubular body and a valve seat insert mounted within the tubular body, the valve seat insert being mounted axially movably relative to the tubular body. By axially positioning the valve seat insert with respect to the body, the preload on the spring can be adjusted.

These features and advantages of the invention, as well as other features and advantages thereof, will become apparent from the following description.

DESCRIPTION OF THE PREFERRED EMBODIMENT

Figure 1:
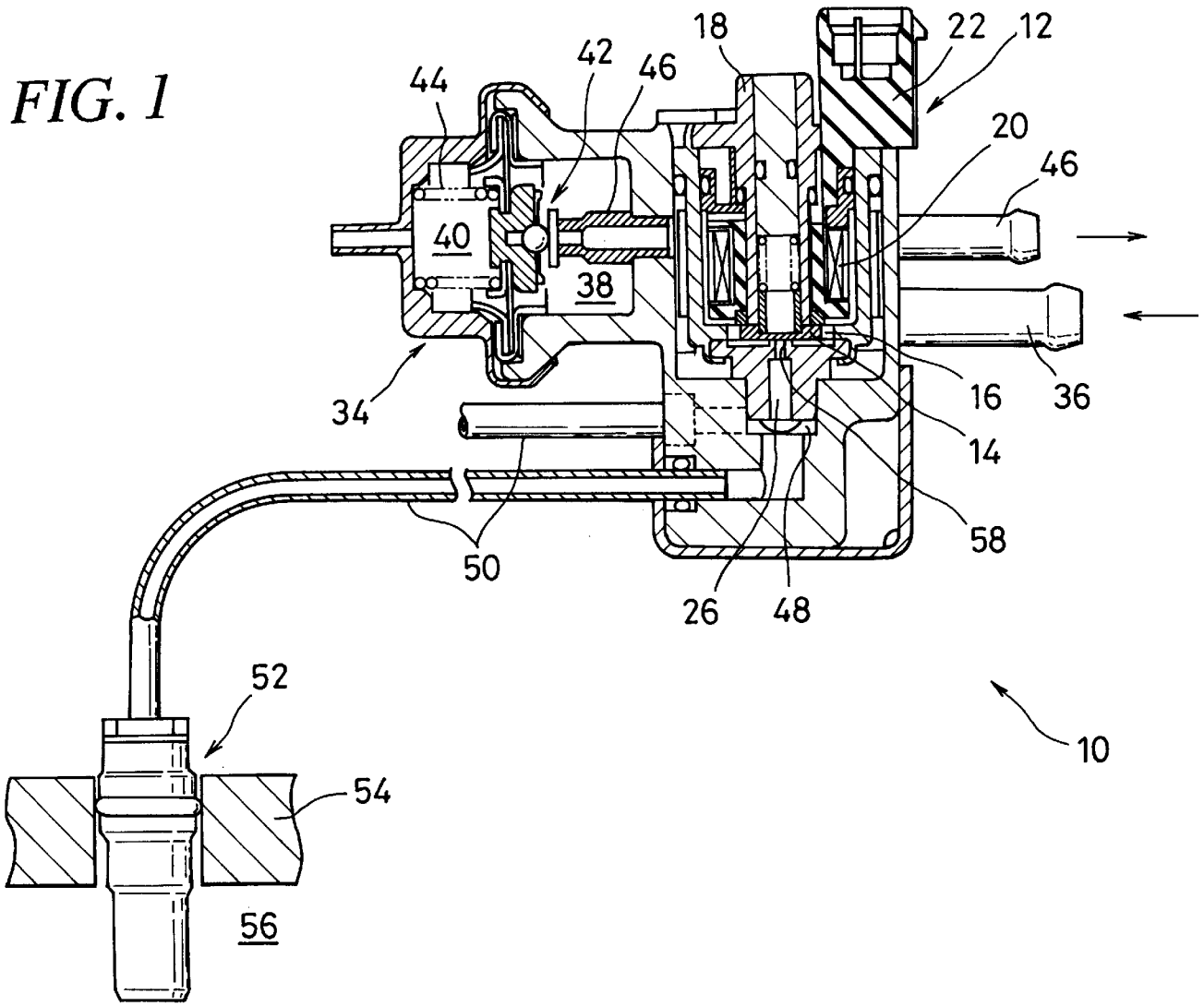
FIG. 1 is an elevational view, partly in cross-section, of the fuel injection system embodying the invention.

Referring to FIG. 1, there is shown a fuel injection system embodying the invention generally designated by the reference numeral 10. Briefly, the injection system 10 is designed such that fuel pressurized by a fuel pump (not shown) is metered by a single solenoid-operated fuel metering valve and the metered fuel under pressure is distributed to a plurality of injection nozzles for injection into respective intake ports of the engine.

More specifically, the injection system 10 includes a solenoid-operated fuel metering valve or injector 12 which is controlled by an electronic engine control unit, not shown. The fuel metering valve 12 includes a movable valve member in the form of a disc 14 which is disposed in a valve chamber 16. The disc valve member 14 may be magnetically attracted toward a magnetic yoke member 18 by a solenoid coils 20 electrically connected to a socket connector 22 which is adapted to be connected in the conventional manner to the engine control unit.

Figure 2:
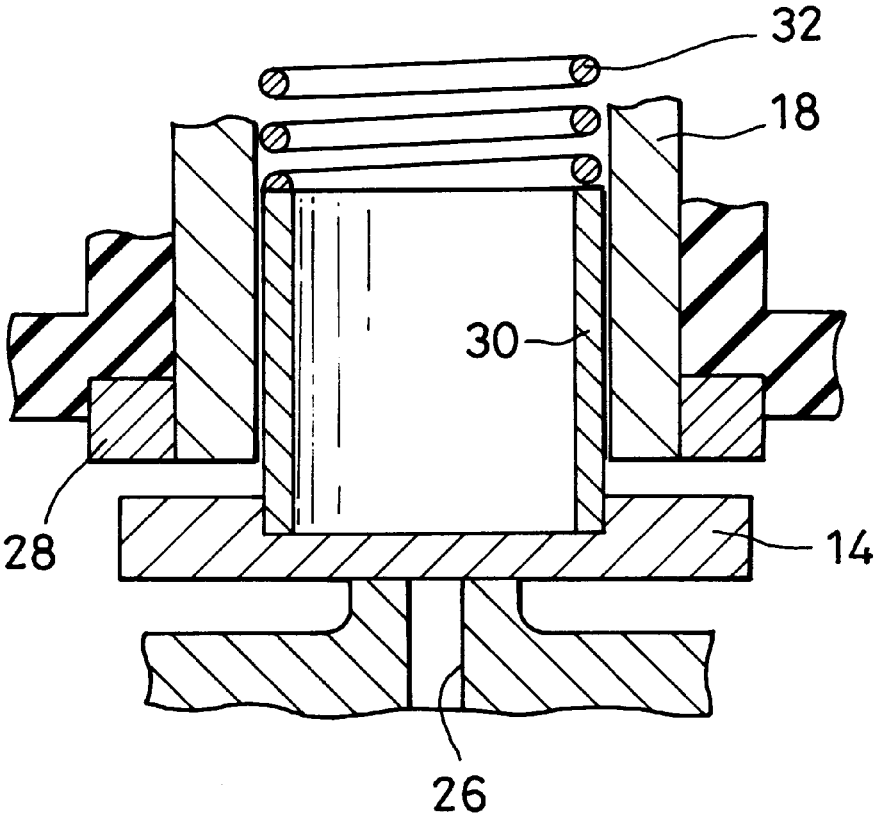
FIG. 2 is an enlarged view of a part of the fuel metering valve shown in FIG. 1, with the disc valve member shown as being in its closed position.
Figure 3:
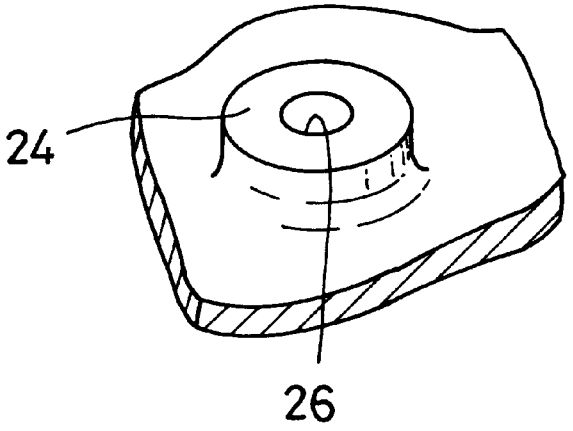
FIG. 3 is an enlarged perspective view showing the valve seat of the fuel metering valve.

As shown enlarged in FIGS. 2 and 3, the fuel metering valve 12 has a circular valve seat 24 adapted to be engaged by the disc valve member 14. The valve seat 24 is provided with a single discharge opening 26 opened and closed by the movable disc member 14. Upon energization of the solenoid coil 20, the disc valve member 14 is moved away from the valve seat 24 to open the discharge opening 26. The disc valve 14 is moveable for a short stroke away from the closed position shown in FIG. 2. The upward stroke of the disc valve member 14 is limited by a stop ring 28. The disc valve member 14 is axially guided by a guide sleeve 30 which is slidably received in a central bore of the yoke member 18 and which is biased by a coiled return spring 32. The return spring 32 serves to urge the disc valve 14 into engagement with the valve seat 24 when the solenoid coil is deenergized.

In the illustrated embodiment, the fuel metering valve 12 incorporates a conventional pressure regulator 34 adapted to regulate the fuel pressure, applied by a fuel pump (not shown) to an inlet 36 for the fuel metering valve 12, to a predetermined pressure level. However, the pressure regulator 34 may be separated from the fuel metering valve 12 and arranged in any other suitable location. The pressure regulator 34 will be only briefly described as it is of the conventional one and does not form part of the invention.

The pressure regulator 34 has an inlet chamber 38 and a pressure chamber 40 divided by a diaphragm valve 42, the inlet chamber 38 being in communication with the valve chamber 16 which, in turn, is in communication with the fuel inlet 36, the pressure chamber 40 being in communication with the throttle body, not shown, of the engine so that the intake vacuum is reflected in the pressure chamber 40. The diaphragm valve 42 is biased by a spring 44 against a valve seat of a drain outlet 46. With this arrangement, the pressure regulator 34 will operate to regulate the fuel pressure in the inlet chamber 38 and, hence, in the valve chamber 16 to a level higher by a predetermined value than the intake vacuum. Any excessive fuel is returned through the drain outlet 46 and a fuel return line, not shown, to a fuel tank.

Returning to FIG. 1, the fuel metering valve 12 has a fuel distribution chamber 48 communicated with the discharge opening 26. A plurality of fuel lines 50, equal in number to the engine cylinders, extend from the distribution chamber 48. Each fuel line 50 is connected to a fuel injection nozzle 52 mounted to an intake manifold 54 to inject fuel into the associated intake port 56.

The discharge opening 26 has a calibrated inlet section 58 of a reduced diameter which acts as a first metering orifice. The first metering orifice 58 operates to meter the fuel distributed to all of the fuel injection nozzles 52.

Figure 4:
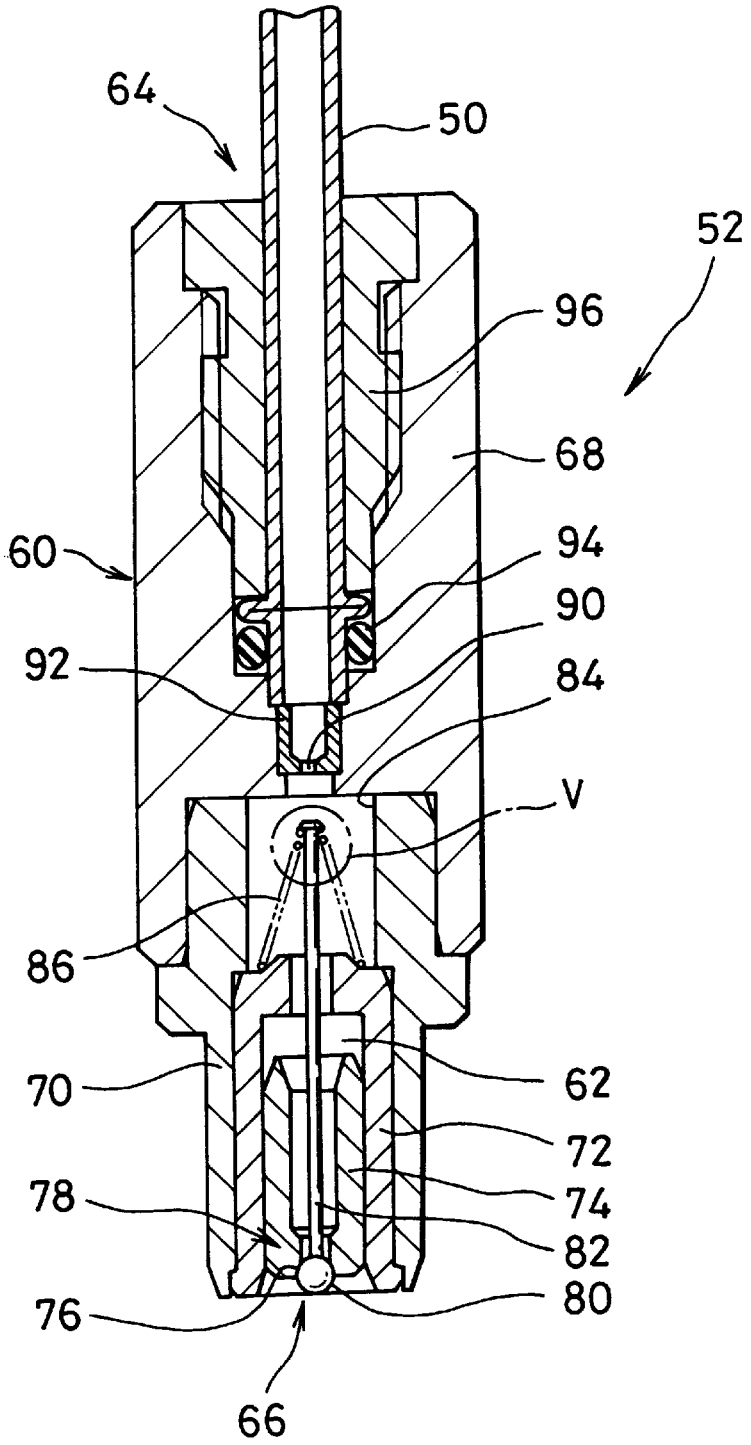
FIG. 4 is a cross-sectional view of the fuel injection nozzle shown in FIG. 1.

Referring to FIG. 4, each injection nozzle 52 includes a tubular nozzle body 60 having an axial passage 62 therethrough from an inlet 64 to a discharge outlet 66. In the illustrated embodiment, the body 60 is made of an upper housing 68 and a lower housing 70, which are axially aligned with each other and suitably held together by means such as interference fit. The lower housing 70 has a stepped bore in which a sleeve 72 is interference fitted.

A valve seat insert 74 is interference fitted within the sleeve 72 in an axially adjustable manner relative to the sleeve 72. The valve seat insert 74 is provided with a conical valve seat 76 controlled by a movable valve member 78. The valve member 78 may be comprised of a steel ball 80 engageable with the valve seat 76 and a valve shaft 82 welded to the ball 80. The valve shaft 82 extends through the valve seat insert 74 and the sleeve 72 and the inner end thereof protrudes into a spring chamber 84 formed in the lower housing 70.

A coiled compression spring 86 is arranged in the spring chamber 84, the lower end of the spring 86 resting on the upper end face of the sleeve 72. As shown enlarged in FIG. 5, the spring 86 is conically tapered with the diameter of each turn being progressively reduced. The upper end of the spring 86 formed by the turn of smallest diameter is supported by a spring retainer 88 having a correspondingly reduced diameter. The spring retainer 88 may consist of a flanged end of the valve shaft 82 which is preferably made by upsetting of the inner end of the valve shaft 82. The compression spring 86 acts to bias the ball valve 80 into engagement with the valve seat 76.

The fuel injection nozzle 52 may be assembled by provisionally positioning the valve seat insert 74 within the sleeve 72, placing the spring 86 on the upper face of the sleeve 72, inserting the valve shaft 82 downwards through the spring 86, sleeve 72 and valve seat insert 74, followed by welding of the lower end of the valve shaft 82 to the steel ball 80.

Thereafter, the valve seat insert 74 may be axially displaced relative to the sleeve 72 so as to adjust the preload imposed on the spring 86 to thereby adjust the opening pressure of the injection nozzle, i.e., the threshold static pressure at which the nozzle 52 starts to open.

Figure 5:
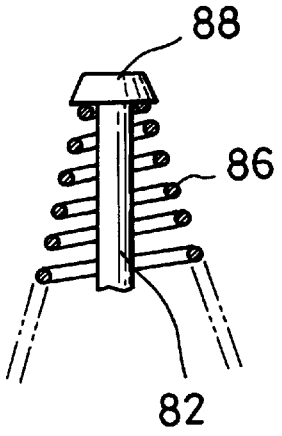
FIG. 5 is an enlarged view showing a part of FIG. 4 encircled by the dotted circle V.

Alternatively, in the case where the ball 80 has already been welded to the valve shaft 82, the injection nozzle 52 may be assembled by provisionally locating the valve seat insert 74 relative to the sleeve 72, placing the spring 86 on the upper face of the sleeve 72, inserting the valve shaft 82 upwards through the valve seat insert 74 and the sleeve 72, engaging the flanged retainer 88 with the turns of the coiled spring 86, and rotating the valve shaft 82 until the retainer 88 clears the uppermost turn of the spring as shown in FIG. 5.

The axial passage 62 of the injection nozzle 52 is provided with an orifice or restriction 90 which, in the illustrated embodiment, is formed in an insert member 92 interference fitted within the upper housing 68. In the fuel injection system 10 according to the invention, the orifice 90 may be referred-to as the second orifice as opposed to the first metering orifice 58 of the fuel metering valve 12. The second orifices 90 are intended to distribute the total amount of fuel metered by the first metering orifice 58 evenly over all the injection nozzles 52. Accordingly, the second orifices 90 of all the injection nozzles 52 are equally calibrated.

Each injection nozzle 52 is fluid tightly connected to an end of the fuel line 50 by means of a sealing ring 94 and a retaining nut 96 threaded into the upper housing 68.

In use, fuel under pressure is supplied from a fuel pump, not shown, to the inlet 36 and the pressure regulator 34 regulates the fuel pressure to 3.0–4.0 kgf/cm$^2$. The solenoid coil 20 of the fuel metering valve 12 is pulsed by the electronic engine control unit, not shown, in accordance with the fuel demands of the engine. Fuel will be injected from respective injection nozzles 52 into the associated intake ports 56 as the fuel pressure applied to the nozzle surpasses the opening pressure of the nozzle.

The total amount of fuel delivered to all the fuel injection nozzles 52 is metered by the first metering orifice 58 and the fuel thus metered is then distributed to the respective injection nozzles.

As the injection nozzles 52 are provided with the second metering orifices 90 which are equally calibrated, the fuel metered by the first orifice 58 is evenly distributed over all the injection nozzles. As a result, each injection nozzle injects an equal amount of fuel.

In contrast to the prior art fuel metering valve wherein the valve seat is provided with a plurality of discharge openings which are simultaneously opened and closed by a common disc valve member, the fuel metering valve according to the invention is stable in operation since the disc valve member has to open and close only a single discharge opening. As a result, the accuracy of metering is improved. The valve seat having a single discharge opening is easy to machine.

As the second orifices 90 of the injection nozzles 52 are equally calibrated, fuel is equally distributed over all the injection nozzles regardless of any possible fluctuation in the operational characteristics of respective injection nozzles.

The diameter of the first metering orifice 58 may be made relatively large since it is intended to meter the total amount of fuel delivered to all the injection nozzles. Accordingly, it is possible to reduce the pressure drop across the fuel metering valve to, in turn, increase the fuel pressure applied to respective injection nozzles. This advantageously provides a wide range of designing flexibility in determining the opening pressure of the injection nozzles. As a result, time and labor required for assembly, inspection and adjustment of the injection nozzles can be considerably reduced.

As the second orifices 90 need not be calibrated small enough to meter the absolute amount of fuel injected per each injection nozzle, the second orifices may be readily machined.

During operation of the fuel injection nozzles 52, the tapered spring 86 is seated at its lower end on the upper face of the sleeve 72 by the largest diameter turn and the upper end thereof abuts by the smallest diameter turn against the spring retainer 88 of a correspondingly small diameter. Accordingly, the tapered spring 86 biases the valve shaft 82 constantly in the axial direction without permitting the wobbling movement of the valve shaft 82.

The tapered configuration of the valve spring 86 permits to make the spring retainer 88 small in size and light in weight or mass.

The advantages of the tapered spring 86 will be described in more detail with reference to FIGS. 6–8. In FIG. 8, there is shown a conventional fuel injection nozzle having a return spring of the conventional design. Parts and members similar to those of FIG. 4 will be indicated by like reference numerals and only the differences will be described. As shown, the prior art injection nozzle includes a cylindrically coiled spring 98 for biasing the ball valve into contact with the valve seat. The upper end of the spring 98 is anchored to the valve shaft 82 by means of a spring retainer 100 fixed to the valve shaft. It will be noted that, as the upper end of the spring is comprised of a turn of a relatively large diameter, the spring retainer 100 has a correspondingly large diameter and, accordingly, the spring retainer has a relatively large mass.

Figure 6A:
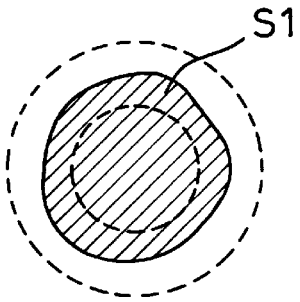
FIGS. 6A and 6B illustrate the fuel spray pattern obtained with the injection nozzle according to the invention and with the conventional injection nozzle.
Figure 6B:
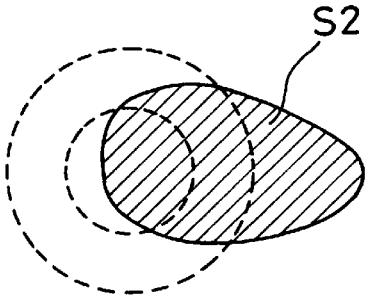

In operation, the valve shaft 82 in the prior art injection nozzle tends to wobble as shown in FIG. 8 by the arrow 102, causing the fuel spray to be deflected as shown by the hatched area S2 in FIG. 6B.

In contrast, in the injection nozzle having the tapered spring 86, the valve shaft is permitted to move without wobbling whereby a uniform circular spray pattern S1 is obtainable as shown in FIG. 6A. Accordingly, pulverization of fuel is improved and the flow rate stabilized.

Figure 7:
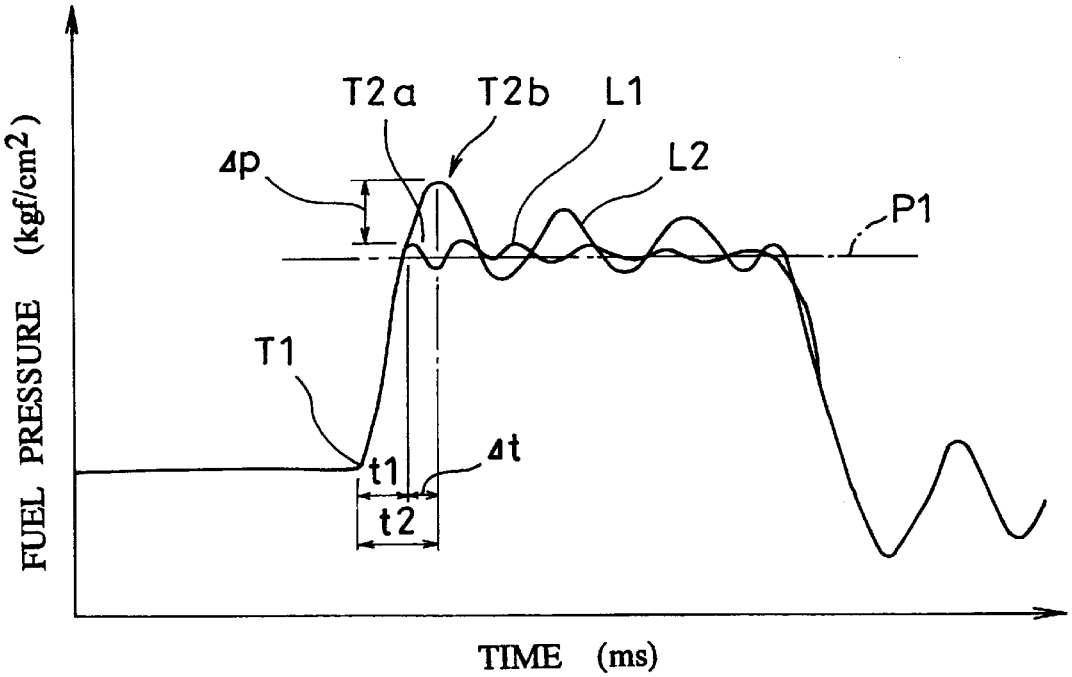
FIG. 7 is a graph showing the variation in response to time of the internal pressure of the injection nozzle according to the invention and of the conventional injection nozzle; and, FIG. 8 is a cross-sectional view of the conventional fuel injection nozzle.
Figure 8:
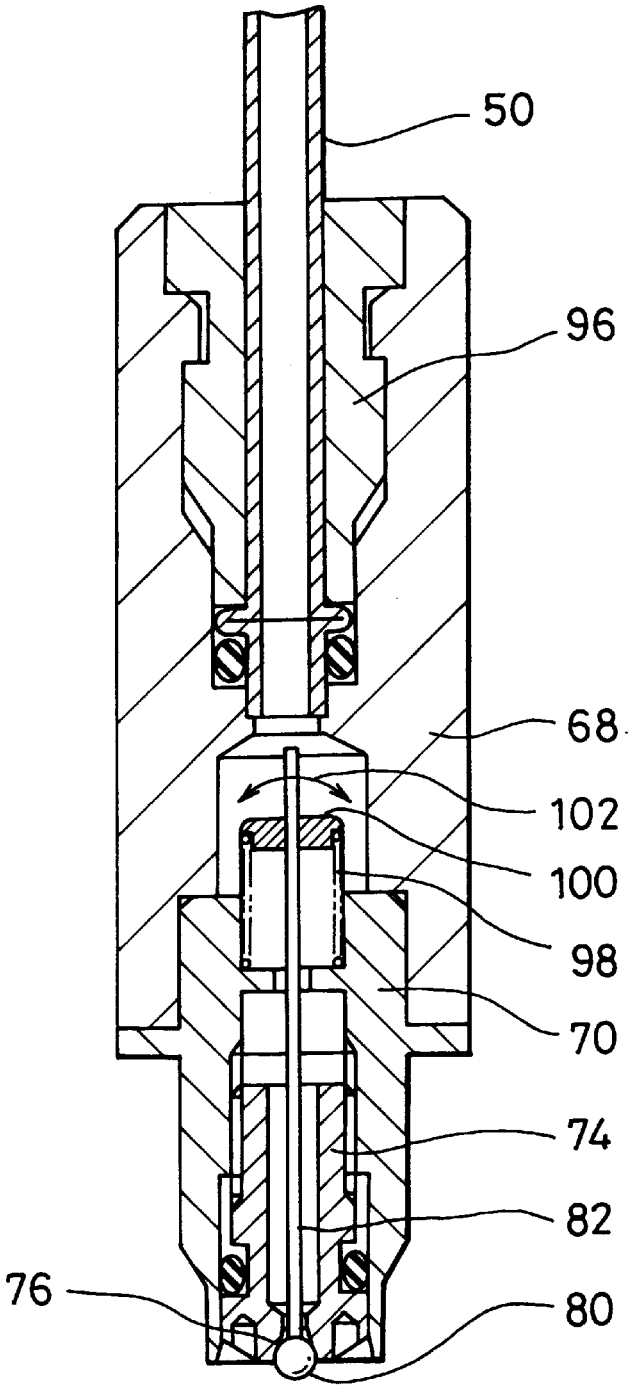
FIG. 8 (PRIOR ART)

Referring to FIG. 7, the responsiveness of the injection nozzles will be discussed. In FIG. 7, the curve or wave form L1 indicates the variation in response to time of the internal pressure of the injection nozzle according to the invention, and the curve L2 represents the pressure variation in the conventional nozzle shown in FIG. 8.

At time T1, the fuel metering valve 12 is pulsed to open so that the pressure in the injection nozzle begin to rise.

In the injection nozzle according to the invention, the nozzle opens at time point T2*a* as soon as the fuel pressure exceeds the opening pressure P1 of the nozzle. The amount of overshoot with respect to the opening pressure P1 is negligibly small. The injection nozzle according to the invention presents a high responsiveness since the mass and, hence, the inertia of the reduced-diameter spring retainer is very small and the valve member is able to quickly follow the pressure variation.

In contrast, the conventional injection nozzle opens at time point T2*b* which is only after the fuel pressure has overshot by delta p. Such high overshoot results from a considerably large mass of the spring retainer 100 that precludes the valve member from promptly responding to the pressure rise. The time point T2*b* at which the nozzle opens is delayed by time interval delta t as compared with the time interval of t1 of the nozzle according to the invention.

By comparing the curves L1 and L2, it will be also noted that in the injection nozzle according to the invention the resonance frequency of the movable part is increased since the amount of overshoot is limited. This is advantageous in avoiding the occurrence of surging.

While the present invention has been described herein with reference to the specific embodiments thereof, it is contemplated that the present invention is not limited thereby and various changes and modifications may be made therein for those skilled in the art without departing from the scope of the invention.

What is claimed is:

1. A fuel injection system comprising:

a solenoid-operated fuel metering valve for metering fuel under pressure and including a pressure regulator for regulating fuel pressure from a fuel pump;

said pressure regulator having an inlet chamber and a pressure chamber divided by a diaphragm valve, said inlet chamber being in communication with a fuel inlet through a valve chamber, said pressure chamber being in communication with a throttle port for connection to a throttle body of an engine so that an intake vacuum is reflected in the pressure chamber, the diaphragm valve being biased by a spring against a valve seat of a fuel drain outlet, a plurality of fuel injection nozzles;

a plurality of fuel lines connected, respectively, at an end thereof to said fuel metering valve and at the other end to said injection nozzles for delivering fuel metered by said metering valve to said injection nozzles;

said fuel metering valve having a single discharge opening and a disc valve in said valve chamber for controlling said single discharge opening by opening and closing said single discharge opening, said single discharge opening being provided with a first metering orifice of reduced diameter acting as a first metering orifice for metering fuel delivered to each one of said plurality of fuel injection nozzles;

each of said fuel injection nozzles having a second metering orifice for metering fuel injected through each fuel injection nozzle, said second metering orifices of all of said fuel injection nozzles being equally calibrated so that fuel metered by said first metering orifice is distributed evenly to said plurality of fuel injection nozzles.

2. A fuel injection system as defined in claim 1, wherein each of said injection nozzles comprises:

a nozzle body having an inlet for fuel under pressure, a discharge outlet, a passage connecting said inlet with said outlet, and a valve seat surrounding said outlet;

a valve member having a closure member cooperating with said valve seat to control discharge of fuel through said outlet and a valve shaft connected to said closure member and extending into said passage; and, a coiled compression spring received in said passage for biasing said closure member into engagement with said valve seat, said spring extending around said valve shaft and having a first end supported by said body and a second end anchored to an inner end of said valve shaft;

said spring being tapered from said first end to said second end to form a reduced diameter turn at said second end.

3. A fuel injection system as defined in claim 2, wherein said valve shaft of said injection nozzle is provided with a flanged inner end serving as a spring retainer for said spring.

4. A fuel injection system as defined in claim 3, wherein said flanged inner end of said valve shaft is formed by upsetting of said inner end.

5. A fuel injection system as defined in claim 2, wherein said nozzle body of said injection nozzle comprises a tubular body and a valve seat insert mounted within said tubular body, said valve seat insert being mounted axially movably relative to said tubular body to adjust a preload imposed on said spring.

6. In a fuel injection system having a solenoid-operated fuel metering valve for metering fuel under pressure, a plurality of fuel injection nozzles, and a plurality of fuel lines connected, respectively, at an end thereof to said fuel metering valve and at the other end to said injection nozzles for delivering fuel metered by said metering valve to said injection nozzles, the improvement comprising:

a first metering orifice of restricted diameter, provided in said fuel metering valve, for metering fuel into a single discharge opening of larger diameter for delivery to the totality of said plurality of fuel injection nozzles; and, a second metering orifice, provided in each of said injection nozzles, for metering fuel injected through respective injection nozzles;

said second metering orifices of all of said injection nozzles being equally calibrated so that fuel metered by said first orifice is distributed evenly to said plurality of fuel injection nozzles.

7. A fuel injection system as defined in claim 6, wherein each of said injection nozzles comprises:

a nozzle body having an inlet for fuel under pressure, a discharge outlet, a passage connecting said inlet with said outlet, and a valve seat surrounding said outlet;

a valve member having a closure member cooperating with said valve seat to control discharge of fuel through said outlet and a valve shaft connected to said closure member and extending into said passage; and a coiled compression spring received in said passage for biasing said closure member into engagement with said valve seat, said spring extending around said valve shaft and having a first end supported by said body and a second end anchored to an inner end of said valve shaft;

said spring being tapered from said first end to said second end to form a reduced diameter turn at said second end.

8. A fuel injection system as defined in claim 7, wherein said valve shaft of said injection nozzle is provided with a flanged inner end serving as a spring retainer for said spring.

9. A fuel injection system as defined in claim 8, wherein said flanged inner end of said valve shaft is formed by upsetting of said inner end.

10. A fuel injection system as defined in claim 7, wherein said nozzle body of said injection nozzle comprises a tubular body and a valve seat insert mounted within said tubular body, said valve seat insert being mounted axially movably relative to said tubular body to adjust a preload imposed on said spring.

* * * * *